United States Patent [19]

Novak et al.

[11] 4,304,349

[45] Dec. 8, 1981

[54] FASTENER DRIVING TOOL

[75] Inventors: Raymond F. Novak, Itasca; Chester A. Berry, Lombard, both of Ill.

[73] Assignee: Duo-Fast Corporation, Franklin Park, Ill.

[21] Appl. No.: 82,916

[22] Filed: Oct. 9, 1979

[51] Int. Cl.[3] ..... B25C 1/04

[52] U.S. Cl. ..... 227/109; 206/338; 227/127; 227/130

[58] Field of Search ..... 206/338; 227/109, 120, 227/123, 127, 130

[56] References Cited

U.S. PATENT DOCUMENTS

| | | | |
|---|---|---|---|
| 2,733,440 | 2/1956 | Jenny | 227/128 |
| 2,979,725 | 4/1961 | Wandel et al. | 227/127 |
| 3,060,439 | 10/1962 | Haubold | 227/120 |
| 3,437,250 | 4/1969 | Fiedler | 227/127 |
| 3,516,590 | 6/1970 | Timmerbeil et al. | 227/123 |
| 4,174,802 | 11/1979 | Maestri | 227/127 X |

FOREIGN PATENT DOCUMENTS

| | | | |
|---|---|---|---|
| 1478934 | 4/1969 | Fed. Rep. of Germany | 227/120 |
| 2757698 | 6/1978 | Fed. Rep. of Germany . | |

*Primary Examiner*—Paul A. Bell

*Attorney, Agent, or Firm*—Mason, Kolehmainen, Rathburn & Wyss

[57] ABSTRACT

A fastener driving tool including a body having a handle and a head portion. A drive assembly includes a driver blade movable along a drive path defined by a nose assembly located below the head portion. A magazine assembly extends from the nose assembly and includes a frame member fixed relative to the tool body, a first track member slidably movable relative to the frame member and a second track member slidably movable relative to the first track member. The track members define a fastener slideway opened for loading of fasteners by movement of the second track member. The nose assembly includes a nose member mounted on the first track member, and movement of the first track member opens the feed path for removal of a jammed fastener. One track member is J-shaped for slidably supporting points of the fasteners and one side of the fastener shanks. The other track member slidably supports the opposite side of the fastener shanks.

20 Claims, 17 Drawing Figures

FASTENER DRIVING TOOL

The present invention relates to fastener driving tools and more particularly to a fastener driving tool having an improveed magazine assembly and nose assembly facilitating the loading, feeding and driving of fasteners.

Power operated tools for driving fasteners typically include a body supporting a pneumatically or electrically powered drive system including a driver blade movable along a drive path for driving fasteners into a workpiece. A supply of fasteners is contained in a magazine assembly from which individual fasteners are introduced into the drive path at a nose assembly.

Two types of problems which are encountered in the use of fastener driving tools of this type are, first, difficulty in quickly and easily loading fasteners into the magazine assembly, and, second, the clearing of jams which may occur at the drive path in the nose assembly. One aspect of the present invention is concerned with providing a fastener driving tool including a magazine and nose structure overcoming these problems in an effective manner.

U.S. Pat. No. 3,437,250 dated Apr. 8, 1969 discloses a fastener driving tool including features intended to avoid difficulties with loading of fasteners and jamming of the drive track. That tool includes a magazine with a housing for holding a supply of fasteners, the housing comprising a fixed side wall member and a slidable side wall member movable to expose the interior of the housing for loading of fasteners into the housing from the side. The slidable structure forms part of the drive track wall, and the drive track is therefore partially opened when the slidable wall is moved rearwardly.

One difficulty with the tool shown in Pat. No. 3,437,250 is that the fixed wall member extends to the drive path region of the nose portion. Thus, even when the movable member is withdrawn, the fixed portion obstructs access to the drive track. The drive track remains largely enclosed, and the clearing of a jammed fastener can be inconvenient and time consuming. Moreover, it is not possible with that tool to open the magazine for loading without also separating the parts of the drive track defining structure.

Among the objects of the present invention are to provide an improved fastener driving tool including an improved magazine and nose assembly; to provide a tool wherein loading of fasteners into the magazine assembly is conveniently and easily accomplished; to provide a tool wherein the clearing of jams in the nose assembly is facilitated; and to provide a fastener driving tool overcoming disadvantages of tools used in the past.

Magazine assemblies for shanked fasteners such as brads having heads and points typically include a pair of supports or rails from which the fasteners or brads are suspended by their heads. The supports may be the opposite legs of a U-shaped track member.

Difficulties have been encounted with conventional magazine assemblies of this type. One disadvantage is that they can be used only with fasteners having relatively large and well defined heads from which the fasteners can reliably be suspended. Another disadvantage is that the fasteners must be loaded into the magazine from the top or an end of the magazine. While fasteners of various lengths can be accommodated in such known magazine assemblies, the points (or workpiece entering ends) of the fasteners are at different distances from the workpiece because the fasteners are suspended from their heads. When a relatively short fastener is driven, the fastener must move a substantial distance before reaching the workpiece and misalignment and jamming or misdriving can result.

Another problem is that when an end fastener is driven from a collation of fasteners, the force required for separation of the end fastener is applied to the adjacent fasteners in the magazine assembly. This force is in turn applied by the fastener heads to the support rails. Over a period of time, the rails can be damaged or separated to the extent that reliable feeding is no longer possible.

Additional objects of the present invention are to provide an improved magazine assembly for shanked fasteners such as brads or the like; to provide a magazine assembly wherein fasteners are supported by their points rather than suspended by their heads by a track structure of novel configuration able to accommodate fasteners of various lengths; and to provide such an assembly wherein the track components are adapted to being separated for convenient loading of the magazine.

In brief, in accordance with the above and other objects and advantages of the present invention, there is provided a fastener driving tool including a body and a drive assembly supported in the body. First and second nose members are normally adjacent one another and define a drive track for reciprocal movement of the driver blade. The first nose member is supported on the tool body. A magazine assembly supports a supply of fasteners to be fed into the drive track. The magazine assembly includes a frame fixed with respect to the tool body and first and second track members cooperating with one another to define a slideway for fasteners in the track. The first track member is movable relative to the second track member so that the slideway of the magazine assembly can be opened for loading of fasteners. The second nose member is supported on the second track member, and the second track member is movable relative to the frame so that the two nose members can be separated for entirely opening the drive track for the clearing of jams.

The slideway defined by the first and second track members receives shanked fasteners such as brads. The first track member is generally of a J-shape with the base of the J defining a slide track for the fastener points and the leg of the J slidably supporting one side of the shank. The second track element slidably supports the opposite side of the fastener shanks. When the elements are separated by sliding of the second track member relative to the first, fasteners can readily be loaded into the J-shaped first track member with their points and one side supported.

The present invention and its objects and advantages may best be understood from the following detailed description of the embodiments of the invention shown in the accompanying drawings, wherein:

FIG. 9 is a sectional view taken along the line 9—9 of FIG. 6;

Figures 1, 2:
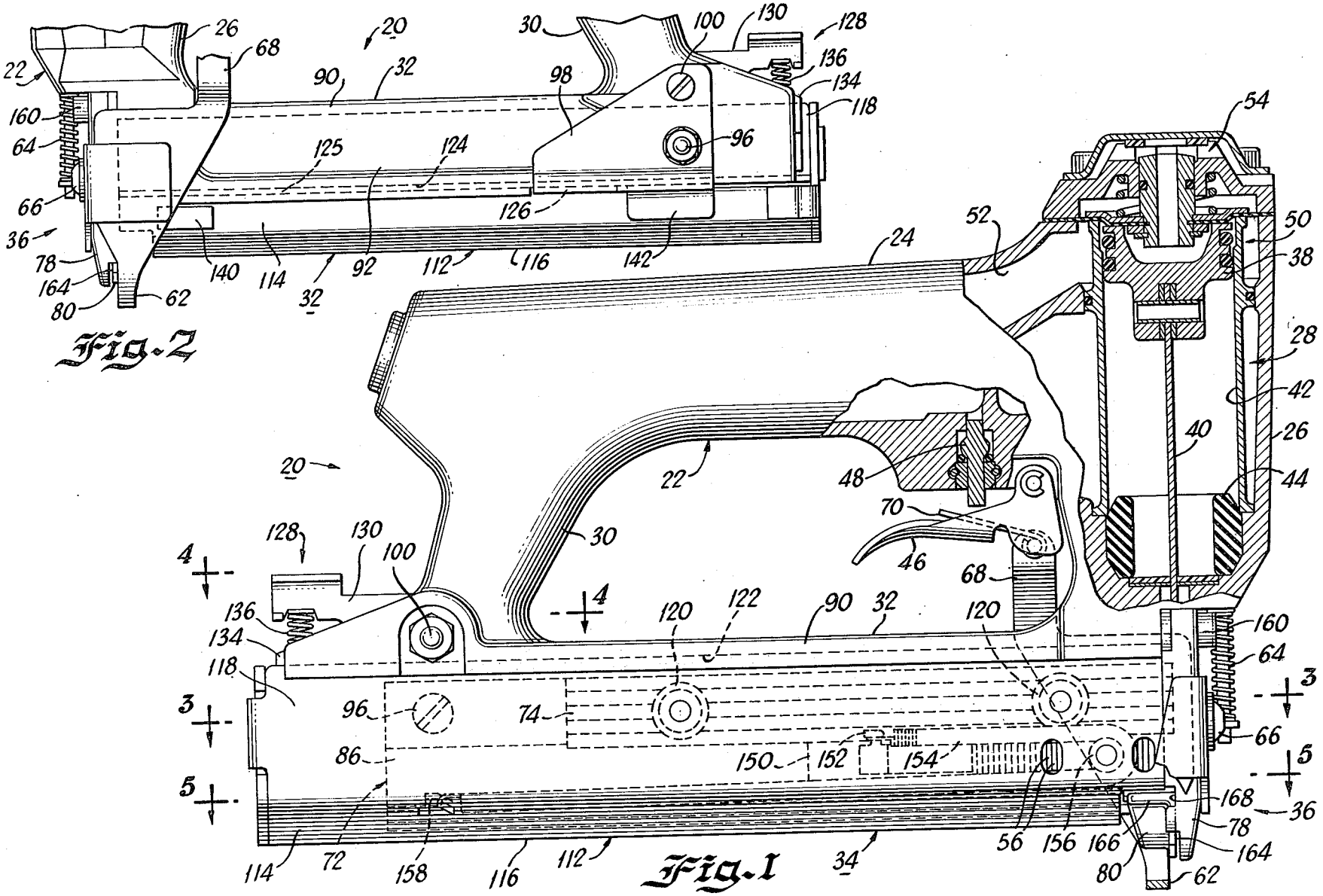
FIG. 1 is a side elevational view, partly in section, of a fastener driving tool constructed in accordance with the present invention.
FIG. 2 is a partial side view, on a reduced scale, of the opposite side of the tool illustrating the magazine and nose assemblies of the tool.

Having reference now to the drawings, in FIGS. 1–15 there is illustrated a fastener driving tool designated as a whole by the reference numeral 20 and constructed in accordance with the principles of the present invention. In general, as shown in FIG. 1 the tool 20 includes a body 22 composed of a handle portion 24 and a head portion 26 at the forward end of the tool containing components of a drive system generally designated as 28. A support portion 30 depends from the rearward end of the handle 24, and an elongated frame or base portion 32 extends rearwardy from the head portion 26 to the support portion 30. A magazine assembly generally designated as 34 is supported by the base or frame body portion 32. A nose assembly generally designated as 36 is disposed beneath the head portion 26 of the body 22 and at the forward end of the magazine assembly 34.

Features of the present invention are applicable to fastener driving tools of various types including both electrically and pneumatically operated tools. Tool 20 illustrated in the drawings is a pneumatically powered tool and incorporates the drive system 28 which may be of a known construction such as that disclosed in U.S. Pat. No. 3,673,922 dated July 4, 1972. In general, drive system 28 includes a piston 38 upon which is supported a fastener driver blade 40. The piston is movable in a cylinder 42 from an illustrated upper, standby position through a drive stroke to a lower position in which the piston 38 engages a bumper 44. A fastener drive stroke is initiated by operation of a trigger 46 which actuates a pilot trigger valve assembly 48 and a cylinder valve assembly 50 to effect entry of compressed air from a reservoir 52 into cylinder 42 above piston 38. During a return stroke of the piston 38, and when the tool is at rest, the upper end of the cylinder is exhausted to atmosphere through an exhaust valve assembly 54. Reference may be had to the above noted U.S. Pat. No. 3,673,922 for a further description of the drive system 28 beyond that required for an understanding of the present invention.

The tool 20 functions to drive a fastener 56 (FIGS. 3, 5 and 6) into a workpiece when the drive system 28 operates in a drive stroke upon operation of trigger 46. The illustrated tool 20 is equipped with a workpiece engaging safety mechanism to prevent operation of the tool unless the nose assembly 36 is placed against a workpiece. Principles of the present invention are applicable to fastener driving tools having no safety mechanism or incorporating safety mechanisms of various types. The illustrated safety mechanism includes a workpiece engaging member 62 biased to a downward position by a spring 64 and supported on the nose assembly 36 for vertical reciprocation by a pair of supports 66. When the nose assembly 36 of the tool 20 is placed into contact with a workpiece, the member 62 moves upwardly and an arm 68 displaces a safety trigger lever 70 to a position permitting actuation of the trigger 46 to operate the pilot trigger valve assembly 48.

In accordance with important features of the present invention, the magazine assembly 34 and the nose assembly 36 of the tool 20 provide important advantages in the loading and the use of the tool. The magazine assembly includes a pair of track members 72 and 74 normally disposed in a closed position (FIGS. 1–9) wherein a supply of fasteners 56 are contained in a slideway 76 defined therebetween. In accordance with the invention, track member 74 is movable relative to track member 72 to an open position shown in FIGS. 10 and 11 wherein convenient loading of a supply of fasteners 56 can readily be accomplished.

Also in accordance with an important feature of the invention, nose assembly 36 includes a pair of nose portions 78 and 80 defining therebetween a drive track or drive path 82 in which a fastener 56 is supported (FIGS. 3 and 5) and from which the fastener 56 is driven in a downward direction by the driver blade 40 upon operation of the piston 38 in a drive stroke. In accordance with the invention, the nose portion 80 is mounted upon track member 72, and track member 72 is movable relative to the tool body 22 from the closed position illustrated in FIGS. 1–11 of the drawings to an open position illustrated in FIGS. 12 and 13 wherein unrestricted access to the drive track 82 permits clearing of fastener jams in the drive track.

Slideway 76 in accordance with one aspect of the present invention accommodates fasteners 56 having shanks, heads and points, the term "point" being used to designate the workpiece entering end of the fastener regardless of its particular shape. The illustrated fasteners 56 comprise brads, but this aspect of the invention is applicable as well to other shanked fasteners such as nails of various types. In the illustrated arrangement, the brads 56 are supplied in collation in that a number of the fasteners are held in side-by-side relationship by a suitable adhesive permitting a number of fasteners to be handled as a unit or stick and permitting individual end fasteners to be separated from the assembly of fasteners by the driver blade 40 in the drive track 82.

Figures 14, 15, 16, 17:
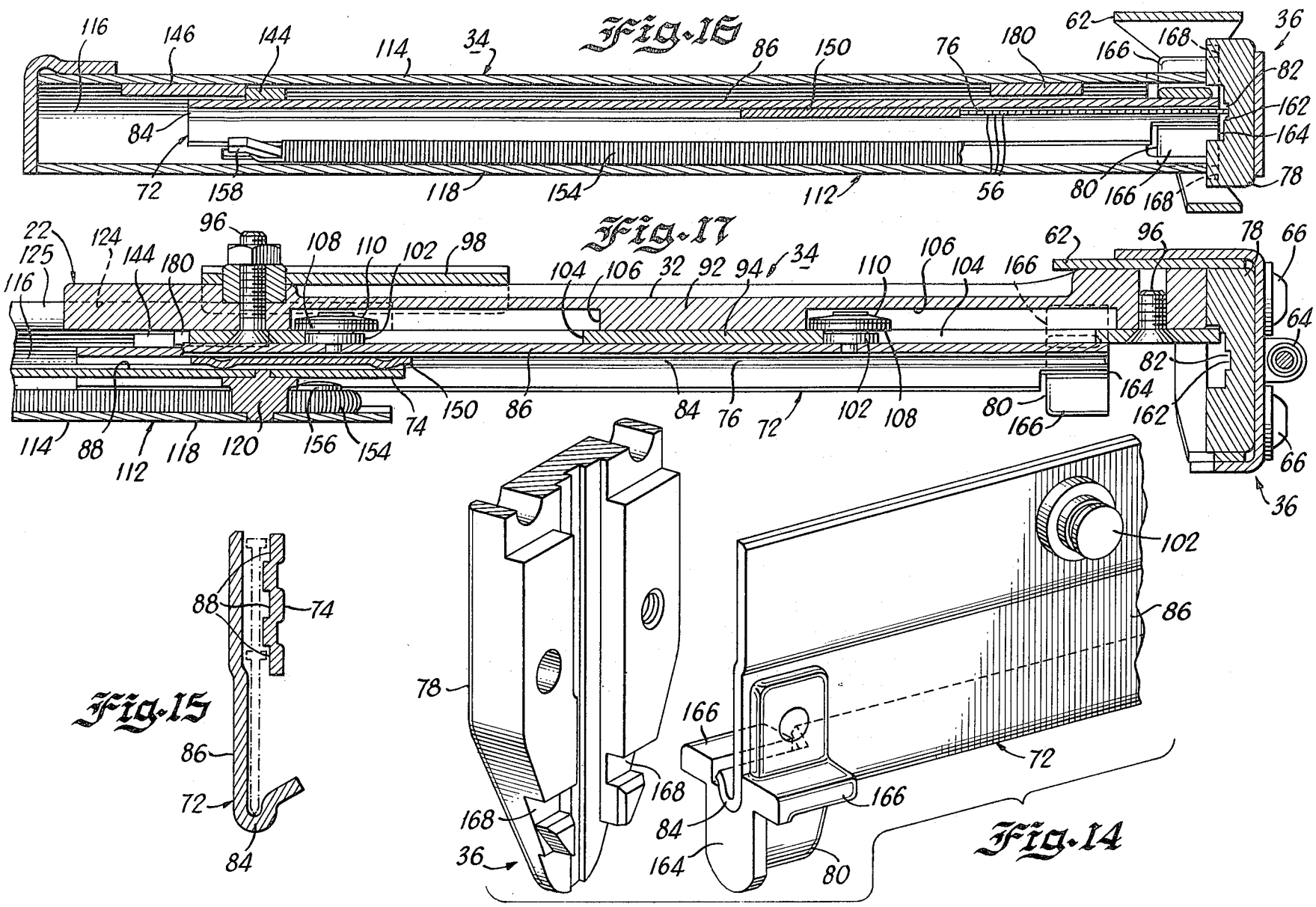
FIG. 14 is a fragmentary perspective view of components of the nose assembly of the tool in disassembly.
FIG. 15 is a fragmentary sectional view of portions of the magazine assembly illustrating fasteners of various lengths in the fastener slideway.
FIG. 16 is a sectional view similar to FIG. 5 illustrating a magazine assembly comprising an alternative embodiment of the invention.
FIG. 17 is a sectional view similar to FIGS. 3 and 13 illustrating the alternative embodiment of FIG. 16.

Track members 72 and 74 are of a novel configuration for supporting fasteners 56 and also permitting separation of the track members for convenient loading. Both track members are of elongated configuration and in the closed position of the magazine assembly 34 each extends from the nose assembly 36 rearwardly along the magazine assembly toward the support portion 30 of the tool body 22. In cross section, and as best illustrated in FIGS. 9 and 15, track member 72 is generally of a J-shape and includes a base portion 84 slidably receiving the points of the fasteners 56 as well as a leg portion 86 slidably receiving one side of the shanks of the fasteners 56.

Track member 74 extends parallel with the leg portion 86 of the member 72 throughout the length of the slideway 76 and slidably receives the opposite side of the shanks of fasteners 56. With this arrangement, when the magazine assembly 34 is in the closed position, the fasteners 56 are retained for sliding movement along the magazine assembly toward the drive track 82. When the track member 74 is moved relative to the track member 72 for loading of the fasteners, the configuration of the track member 72 permits fasteners 56 to be loaded into the magazine assembly and held both at the points and at one side of the fastener shanks until the track member 74 is returned to the closed position.

The slideway 76 is able to accommodate fasteners 56 of various lengths. For this reason, the slideway defining surface of the track member 74 is provided with a number of elongated grooves or recesses 88 located parallel to and at selected different distances from the base 84 of the track member 72. The locations of grooves 88 are selected to accommodate the heads of fasteners 56 as shown in FIG. 9, as well as fasteners having two other lengths as indicated in FIG. 15. Regardless of the length of fastener used, the opposed sides of the fastener shanks are slidably supported, the fastener points are supported by track member base 84, and the fastener heads are loosely retained within a groove 88 so that the fastener points remain adjacent to the base 84.

Figures 5, 6, 7, 8:
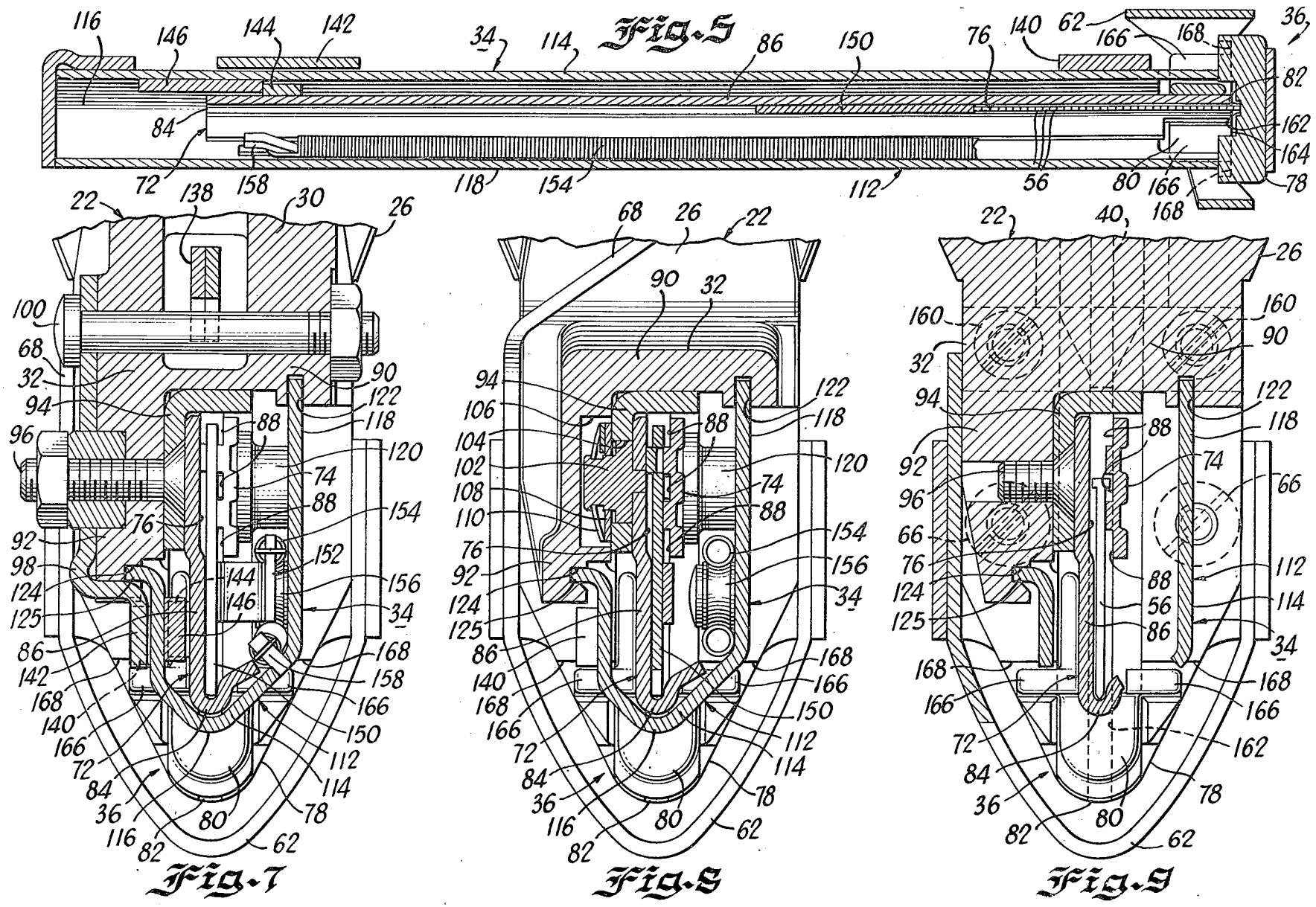
FIG. 6 is a sectional view taken along the line 6—6 of FIG. 3.
FIG. 7 is a sectional view taken along the line 7—7 of FIG. 6.
FIG. 8 is a sectional view taken along the line 8—8 of FIG. 6.

Proceeding now to a more detailed description of the fastener driving tool 20, the components of the magazine assembly 36 including the track members 72 and 74 are supported for movement along the base or frame portion 32 of the body 22. The frame 32 is formed integrally with the remainder of the body 22 and, as best seen in FIGS. 7–9, is generally in the form of an elongated and inverted L-shaped structure including a base portion 90 and a downwardly depending flange or leg portion 92. An elongated L-shaped bracket 94 is mounted against the frame 32 and is fastened to leg 92 by a pair of fasteners 96. A magazine support bracket 98 (FIGS. 2, 3 and 7) is attached to the opposite, outer surface of leg 92 by one of the fasteners 96 and by an additional fastener 100.

Figure 13:
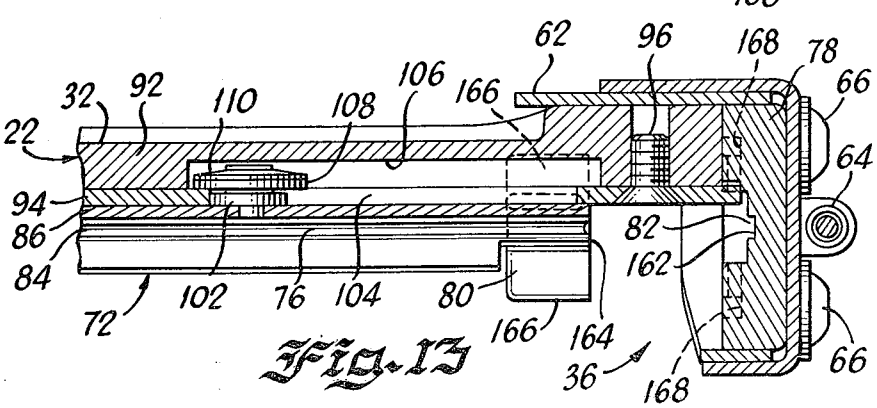
FIG. 13 is a sectional view taken along the line 13—13 of FIG. 12.
Figure 12:
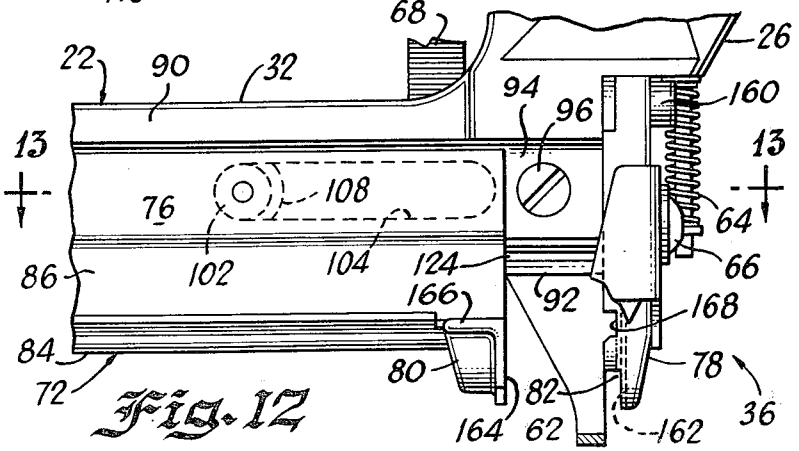
FIG. 12 is a fragmentary side view similar to a portion of FIG. 10 illustrating the magazine and nose assembly in an open position for clearing of the drive track.

Track member 72 is retained and slidably supported upon the fixed frame structure including frame member 32 and bracket 94 for movement between a closed position (FIGS. 5, 6 and 10) and an open position (FIGS. 12 and 13). A pair of support pins 102 attached to the leg portion 86 of the track member 72 are slidably received in guide slots 104 in the bracket 94 and extend into recesses 106 in the leg portion 92 of the frame 32. As best seen in FIG. 8, the track member 72 is frictionally retained in any position by a pair of friction washers 108 supported on pins 102 and biased against bracket 94 by a pair of spring washers 110. In the closed position of track member 72 relative to the frame 32, the forward end of the track member is adjacent the drive track 82. Movement to the open position is limited by engagement of pins 102 with the rearward ends of guide slots 104 as shown in FIGS. 12 and 13.

Track member 74 is also guided for sliding movement relative to the frame portion 32 of the housing body 22. The track member 74 is part of a magazine slide assembly generally designated as 112. Assembly 112 includes in addition to track member 74 a magazine cover or housing 114. As best seen in FIGS. 7 and 8, the cover 114 is generally of a J-shape, in reverse orientation to the J-shaped track member 72, and includes a base portion 116 and an upstanding leg portion 118. The cover 114 and the track member 74 are held in assembly by a pair of studs 120 (FIG. 3) attached between the track member 74 and the leg portion 118 of the cover 114. The cover 114 cooperates with leg portion 92 of frame 32 to enclose the magazine assembly 34, and the track member 74 is sandwiched between the leg 86 of track member 72 and the leg 118 of cover 114. Base 116 of cover 114 closely cups the base 84 of track member 72 so that the points of fasteners 56 are spaced a minimum distance from a workpiece regardless of their length.

In order to capture the slide assembly 112 for sliding movement, the base portion 90 of the frame 32 includes a guide groove 122 and the leg 92 of the frame 32 includes a guide groove 124 (FIGS. 7–9). The upper edge of the magazine cover leg 118 is slidably received in the groove 122, while the base portion 116 includes an outwardly turned lip 125 slidably received in the groove 124. The magazine support bracket 98 includes an inturned guide portion 126 (FIG. 7) forming a continuation of the groove 124 and assuring that the lip 125 is supported when the slide assembly 112 is moved to its open position.

Figures 3, 4, 5:
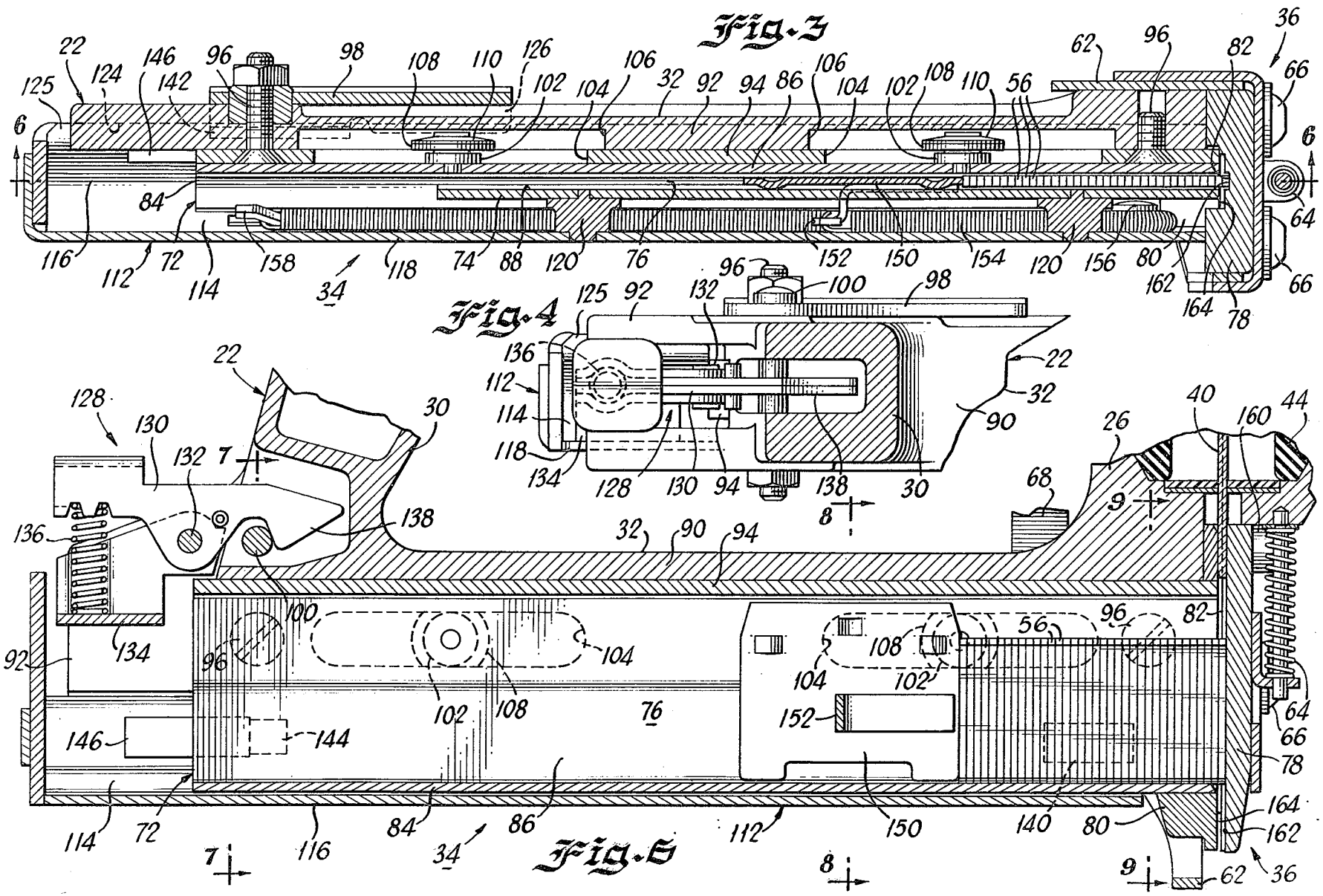
FIG. 3 is a sectional view on an enlarged scale taken along the line 3—3 of FIG. 1.
FIG. 4 is a sectional view taken along the line 4—4 of FIG. 1.
FIG. 5 is a sectional view taken along the line 5—5 of FIG. 1.

Slide assembly 112 is releasably retained in the closed position by means of a latch mechanism generally designated as 128 including a manually releasable latch lever 130 best illustrated in FIGS. 4 and 6. Lever 130 is pivotally supported upon a pivot pin 132 carried by a latch base bracket attached to a rearward portion of the frame 32. A spring 136 holds the latch lever 130 in a latched position with a catch portion 138 of lever 130 in locking relation with a latch pin formed by an intermediate part of the fastener 100.

In order to release the slide assembly 112 from the closed position illustrated in FIGS. 4 and 6, the lever 130 is manually depressed to lift the catch portion 138 from the latch pin. The slide assembly 112 can then be moved rearwardly to a full open position illustrated in FIGS. 10 and 11. In this position, a stop member 140 attached to the cover 114 engages a stop projection 142 of the support bracket 98 to prevent further rearward movement of the slide assembly 112 from the tool 20.

The track member 72 is held in its closed position when the slide assembly 112 and the track member 74 are in their closed position. As illustrated in FIG. 5, an abutment 144 carried on the track member 72 engages an abutment 146 carried on the cover 114 when the slide assembly 112 is in the closed position. In this closed position, the cover 114 encloses the interior of the magazine assembly 34 and prevents opening movement of the track member 72. Moreover, if the slide assembly 112 is closed while the track member 72 is in its open position, engagement of the abutments 144 and 146 assures simultaneous closing of both track members.

Figure 10:
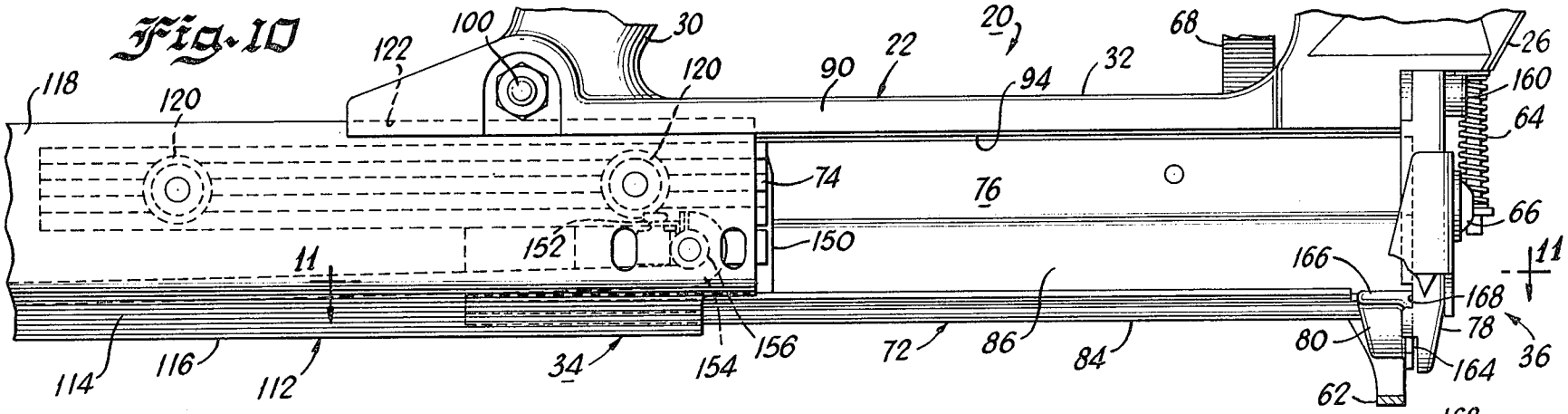
FIG. 10 is a fragmentary side view similar to part of FIG. 1 illustrating the magazine assembly of the tool in an open position for loading.

Fasteners captured in the slideway 76 are urged toward the drive track 82 in the nose assembly 36 by means of a pusher blade 150 best illustrated in FIGS. 3 and 6–8. Blade 150 is captured for sliding movement between the track members 72 and 74 and includes an outwardly projecting finger 152 to which is secured one end of a biasing spring 154. Spring 154 extends forwardly from finger 152 around a pulley 156 (FIG. 8) supported on cover 114, and is attached in tension to a finger or pin 158 located at the rearward portion of the cover 114. Consequently, the pusher blade 150 is continuously biased in the forward direction along slideway 76. As seen in FIG. 10, when the magazine slide assembly 112 is moved to the open position, the blade 150 is also retracted for unobstructed loading of the J-shaped track member 72. The blade 150 is retained within the cover 114 in this open position by engagement of the finger 152 with the pulley 156.

Figure 11:
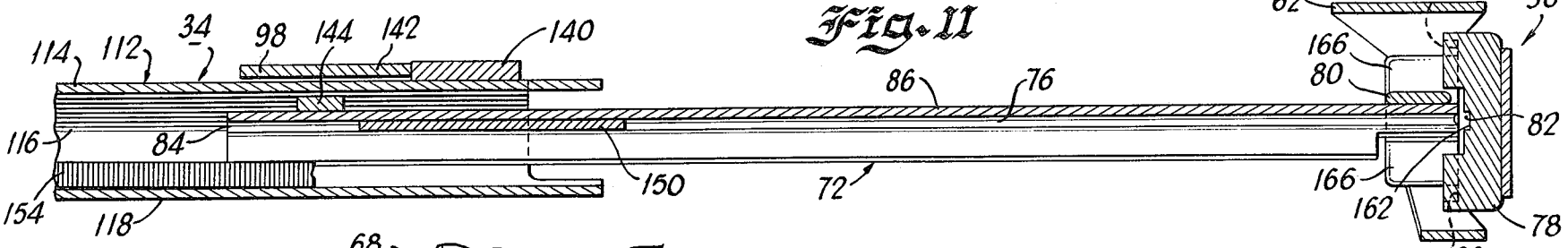
FIG. 11 is a sectional view taken along the line 11—11 of FIG. 10.

Upon manually releasing the latch mechanism 128 and pulling the magazine slide assembly 112 rearwardly to the open position illustrated in FIGS. 10 and 11, an assembly of fasteners 56 can easily be loaded into the magazine assembly 34. In this open position, the track member 72 remains in place, and an assembly or stick of fasteners 56 is simply laid into the track member 72 with the points supported within the base 84 and a side of the fasteners resting against the leg portion 86. When the slide assembly 112 is returned to and latched in the closed position, the fasteners 56 are securely captured for sliding movement in the slideway 76 and are resiliently biased toward the drive track 82 by the pusher blade 150.

One important advantage of the magazine assembly 34 and nose assembly 36 of the tool 20 is that if a jam occurs in the drive track 82, the nose portions 78 and 80 can readily be separated to open up the drive track and permit easy clearing of the jam. In a normal loading operation as illustrated in FIGS. 10 and 11, the nose portions 78 and 80 are undisturbed. However, in order to clear a jam, the track member 72 and the nose portion 80 may be moved rearwardly to an open position illustrated in FIGS. 12 and 13 whereupon the drive track 82 is completely opened up and is readily accessible.

More specifically, the drive track 82 in the region of the nose assembly 36 is entirely defined between the nose portion 78 and the nose portion 80. Nose portion 78 is attached to the housing 22 by fasteners 160. The forward wall of the drive track 82 is defined by a vertically extending groove 162 formed in the rearwardly facing surface of the nose portion 78.

The rear wall of the drive track 82 is defined by a forwardly facing wall 164 of the nose portion 80 as best illustrated in FIGS. 14, 11 and 5. Moreover, wall 164 extends laterally across the entire nose assembly 36. Nose portion 80 is secured to the forward end of the track member 72. Consequently, when the track member 72 is withdrawn as illustrated in FIGS. 12 and 13, nose portions 78 and 80 are separated and drive track 82 is opened up for full access from the rear and both sides.

The portions of the nose assembly 36 adjacent the drive track 82 may be subjected to substantial impacts and forces incident to separation of a fastener 56 from an assembly of fasteners and driving of the fastener 56 into a workpiece by the driver blade 40. In order to render the nose assembly 36 rigid, the nose portions 78 and 80 are securely interlocked in the closed position. Nose portion 80 includes a pair of laterally extending projections 166, and these projections are received in a pair of laterally extending recesses 168 in the nose portion 78 to the end that the nose portions 78 and 80 cannot be vertically displaced relative to one another during a drive stroke.

In the embodiment of the invention illustrated in FIGS. 1–15, in order to open the track member 72 and nose portion 80, the slide assembly 112 is first opened. Then the track member 72 is grasped and pulled to the rear. This assures that when the slide assembly 112 is opened for loading of fasteners, the track member 72 and the nose portion 80 remain undisturbed.

In FIGS. 16 and 17 there is illustrated an alternative embodiment of the invention wherein separation of the nose assembly for clearing a jam can be effected by a single rearward movement of the magazine slide assembly. The elements of the structure illustrated in FIGS. 16 and 17 are designated with the same reference characters used above except in the case of elements of the alternative embodiment which differ from the elements of the tool 20 illustrated in FIGS. 1–15.

As best seen in FIG. 16, the cover 114 of the slide assembly 112 includes an internally located stop member 180. When the slide assembly 112 is unlatched and moved rearwardly for loading of fasteners 56 into the track member 72, the stop 180 moves into engagement with the abutment 144. Due to frictional retention of the track member 72 against the bracket 94, this provides a stop in the open position for loading of the magazine.

In order to open the track member 72 and the nose portion 80, the slide assembly 112 is moved further rearwardly with greater force to overcome the frictional retention. This causes the track member 72 and the nose portion 80 to be withdrawn to the position of FIG. 17 for clearing of a jam in the drive track 82. Consequently, in the embodiment of FIGS. 16 and 17, both of the track members 72 and 74 as well as the nose portion 80 may be moved from the closed to the open position by retracting the magazine slide assembly 112 through two stages or increments of movement.

While the invention has been described with reference to details of the illustrated embodiments, such details are not intended to limit the invention as defined in the appended claims.

What is claimed and desired to be secured by Letters Patent of the United States is:

1. A magazine assembly for supporting a supply of shanked fasteners in a fastener driving tool wherein said magazine assembly is secured to said fastener driving tool, said magazine assembly comprising first and second elongated and parallel track members defining therebetween a fastener slideway, said first track member including in cross section a base portion for slidably receiving the points of fasteners in the slideway and an upwardly extending leg portion for slidably supporting one side of the shanks of fasteners in the slideway, said second track member including a side wall portion for slidably supporting the opposite side of fasteners in the slideway; and means mounting said first and second track members for relative movement to separate said second track member from said first track member for loading of fasteners into said first track member.

2. A fastener driving tool for driving fasteners into a workpiece and comprising:

a body;

a drive assembly supported in said body and including a driver blade;

first and second nose members normally adjacent one another to define a drive track for reciprocal movement of the driver blade, said first nose member being supported by said body;

a magazine assembly for supporting a supply of fasteners and advancing them one-at-a-time into said drive track;

said magazine assembly including a frame portion fixed with respect to said body;

first and second track members cooperating to define a slideway for fasteners in said magazine;

said first track member being movable relative to said second track member for selectively opening and closing said slideway for loading of fasteners into the magazine assembly;

said second nose member being supported on said second track member, and said second track member being movable relative to said frame portion permitting separation of the nose members and clearing of said drive track.

3. The fastener driving tool of claim 2, said first and second track members being elongated and slidable relative to one another in the longitudinal direction.

4. The fastener driving tool of claim 3, said second track member being slidable in the longitudinal direction relative to said frame portion.

5. The fastener driving tool of claim 2, one of said nose members including recess means and the other including projection means received in said recess means for interlocking said nose members in the adjacent position.

6. A magazine for a fastener driving tool including a frame and of the type including a drive member movable through a drive path for driving fasteners with shanks into a workpiece, said magazine supported by said frame and comprising:

a feed track structure opening into the drive path and slidably supporting a supply of fasteners;

pusher means movable along said feed track structure and engageable with fasteners supported in the feed track structure;

biasing means coupled to said pusher means for biasing the pusher means toward the drive path;

a first elongated track element slidably mounted on said frame extending from the drive path and defining part of said feed track structure;

said first element being generally J-shaped in section with the base of the J defining a slide track for the workpiece entering end of the fastener shanks and the leg of the J slidably supporting one side of the shanks;

a second elongated track element extending parallel to the first element and slidably supporting the opposite side of the fastener shanks; and means for sliably mounting said second elongated track element relative to said frame, said second track element being withdrawable away from said drive path for access to said first track element.

7. The magazine of claim 6, said second track element being longitudinally slidable relative to said first track.

8. The magazine of claim 7, further comprising stop means engagable with said second track element for preventing separation of said first and second track elements.

9. The magazine of claim 5, one of said track elements having a plurality of longitudinally extending grooves spaced different distances from and parallel to said slide track for receiving head portions of fasteners of different lengths.

10. The magazine of claim 5, said magazine including an elongated housing member slidably mounted thereon and extending parallel to said track elements, said housing member being generally J-shaped and in reverse orientation to said first track elements, the base portion of said housing member cupping the base portion of the first track element, and the second track element being sandwiched between the leg portions of the first track element and the housing member.

11. The magazine of claim 10, said housing member and said second track element being interconnected and being mounted for telescoping sliding movement longitudinally of said first track element.

12. The magazine of claim 10, said first track element being mounted for sliding movement toward and away from said drive path.

13. A tool for driving fasteners having points and shanks into a workpiece, said tool comprising a body, a drive system including a driver blade movable along a drive path, a magazine assembly supported by the body for serially feeding fasteners into the drive path, said magazine assembly including an elongated frame portion fixed to said body, a first elongated track portion supporting the points and one side of the shanks of the fasteners for sliding movement along a feed path toward the drive path, a second elongated track portion supporting the other side of the shanks of the fasteners for sliding movement along the feed path; means mounting said first track portion for sliding movement along said frame portion toward and away from the drive path through a first distance; and means mounting said second track portion for sliding movement along said frame portion toward and away from said drive path through a second distance greater than said first distance.

14. The tool of claim 13, further comprising an elongated housing member serving in cooperation with said frame member to enclose said first track portion, said housing member being connected to and movable with said second track portion.

15. The tool of claim 14, said housing member including a portion abutting said first track portion for preventing movement of the first track portion away from the feed path when the second track portion is adjacent the feed path.

16. The tool of claim 15, further comprising a latch mechanism on said housing member and said frame member for releasably latching said housing member with said second track portion adjacent the feed path.

17. The tool of claim 15, further comprising a stop on said frame portion engagable with said first track portion limiting its movement to said first distance.

18. The tool of claim 17, further comprising stop means engagable by said second track portion upon movement away from said drive path.

19. The tool of claim 18, said stop means being fixed relative to said frame member.

20. The tool of claim 18, said stop means being fixed relative to said first track portion.

* * * * *

US004304349B1

REEXAMINATION CERTIFICATE (2804th)

United States Patent [19] [11] B1 4,304,349

Novak et al. [45] Certificate Issued Feb. 27, 1996

[54] FASTENER DRIVING TOOL

[75] Inventors: Raymond F. Novak, Itasca; Chester A. Berry, Lombard, both of Ill.

[73] Assignee: Duo-Fast Cord, Franklin Park, Ill.

Reexamination Request:
No. 90/003,728, Feb. 17, 1995

Reexamination Certificate for:

| | |
|---|---|
| Patent No.: | **4,304,349** |
| Issued: | **Dec. 8, 1981** |
| Appl. No.: | **82,916** |
| Filed: | **Oct. 9, 1979** |

[21] Appl. No.: 82,916

[51] Int. Cl.[6] ..... B25C 1/04

[52] U.S. Cl. ..... 227/109; 206/338; 227/127; 227/130

[58] Field of Search ..... 227/109, 123, 227/120, 127, 130, 119, 109; 206/338

[56] References Cited

U.S. PATENT DOCUMENTS

| | | |
|---|---|---|
| 2,733,440 | 2/1956 | Jenny . |
| 2,979,725 | 4/1961 | Wandel et al. . |
| 3,060,439 | 10/1962 | Haubold . |
| 3,437,250 | 4/1969 | Fiedler . |
| 3,516,590 | 6/1970 | Timmerbeil et al. . |
| 3,720,364 | 3/1973 | Maestri . |
| 4,174,802 | 11/1979 | Maestri . |

FOREIGN PATENT DOCUMENTS

| | | |
|---|---|---|
| 1478934 | 4/1969 | Germany . |
| 2757698 | 6/1978 | Germany . |
| 46-20958 | 7/1971 | Japan . |
| 52-54981 | 4/1977 | Japan . |
| 53-11432 | 3/1978 | Japan . |

*Primary Examiner*—Kenneth E. Peterson

[57] ABSTRACT

A fastener driving tool including a body having a handle and a head portion. A drive assembly includes a driver blade movable along a drive path defined by a nose assembly located below the head portion. A magazine assembly extends from the nose assembly and includes a frame member fixed relative to the tool body, a first track member slidably movable relative to the frame member and a second track member slidably movable relative to the first track member. The track members define a fastener slideway opened for loading of fasteners by movement of the second track member. The nose assembly includes a nose member mounted on the first track member, and movement of the first track member opens the feed path for removal of a jammed fastener. One track member is J-shaped for slidably supporting points of the fasteners and one side of the fastener shanks. The other track member slidably supports the opposite side of the fastener shanks.

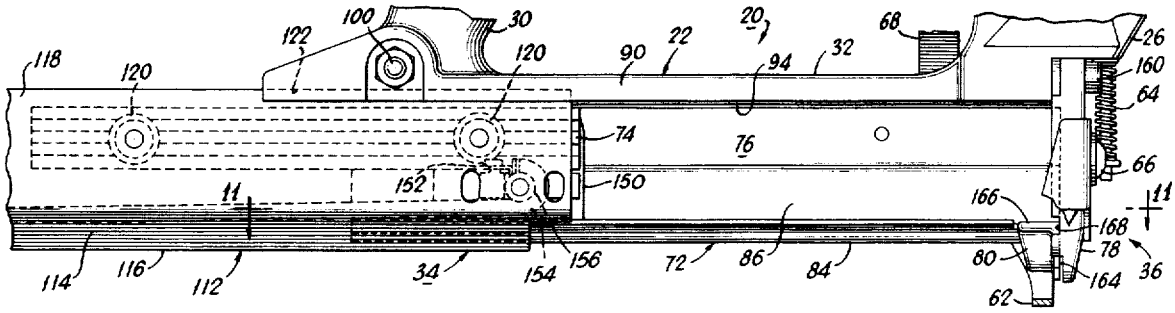

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–20 is confirmed.

Claim 1 is determined to be patentable as amended.

New claim 21 is added and determined to be patentable.

1. A magazine assembly for supporting a supply of [shanked] fasteners *having shanks, points and enlarged heads* in a fastener driving tool wherein said magazine assembly is secured to said fastener driving tool, said magazine assembly comprising first and second elongated and parallel track members defining therebetween a fastener slideway *extending in a fastener feed direction*, said first track member including in cross section a base portion for slidably receiving the points of fasteners in the slideway and an upwardly extending leg portion *defining a first side wall* for slidably supporting one side of the shanks of fasteners in the slideway, said second track member including *second upwardly extending* side wall [portion] for slidably supporting the opposite side of *the shanks of* fasteners in the slideway, *said first and second upwardly extending side walls including means for slidably, loosely retaining the heads of fasteners projecting laterally from both sides of said shanks perpendicular to said fastener feed direction, said retaining means including a plurality of parallel, spaced apart unobstructed grooves in one of said side walls for slidably, loosely retaining the heads of fasteners of different lengths*; and means mounting said first and second track members for relative movement to separate said second track member from said first track member for loading of fasteners into said first track member.

*21. The combination comprising a fastener driving tool, a magazine assembly secured to said fastener driving tool and a supply of fasteners supported in said magazine assembly, said fasteners having shanks with first and second opposed sides, points and enlarged heads projecting laterally from both said opposed sides of said shanks, said magazine assembly having first and second elongated and parallel track members defining therebetween a fastener slideway containing said supply of fasteners, one of said track members including in cross section a base portion slidably receiving said points of said fasteners in the slideway and an upwardly extending leg portion defining a first side wall slidably supporting said first side of said shanks of said fasteners in the slideway, the other of said track members including a second upwardly extending side wall slidably supporting said second side of said shanks of said fasteners in the slideway, said first and second upwardly extending side walls including means for slidably, loosely retaining said heads of said fasteners, said retaining means including a plurality of parallel, spaced apart unobstructed grooves in one of said side walls for slidably, loosely retaining heads of fasteners of different lengths; said heads of said fasteners in said slideway being located in one of said grooves; and means mounting said first and second track members for relative movement to separate said second track member from said first track member for loading of fasteners into said first track member.*

* * * * *